United States Patent [19]

Allen

[11] 4,285,409

[45] Aug. 25, 1981

[54] TWO CONE BIT WITH EXTENDED DIAMOND CUTTERS

[75] Inventor: James H. Allen, Lakewood, Calif.

[73] Assignee: Smith International, Inc., Newport Beach, Calif.

[21] Appl. No.: 52,879

[22] Filed: Jun. 28, 1979

[51] Int. Cl.[3] ..... E21B 9/08

[52] U.S. Cl. ..... 175/336; 175/339; 175/410

[58] Field of Search ..... 175/329, 336, 393, 410, 175/339

[56] References Cited

U.S. PATENT DOCUMENTS

| | | | |
|---|---|---|---|
| 3,066,749 | 12/1962 | Hildebrandt | 175/336 |
| 3,269,469 | 8/1966 | Kelly, Jr. | 175/336 |
| 3,548,959 | 12/1970 | Hasiba | 175/410 |
| 3,871,488 | 3/1975 | Sabre | 175/410 |
| 4,006,788 | 2/1977 | Garner | 175/336 |

*Primary Examiner*—James A. Leppink

*Attorney, Agent, or Firm*—Robert G. Upton

[57] ABSTRACT

A hybrid rock bit is disclosed which consists of a pair of cone cutters mounted to legs 120° apart with an extended drag bit leg occupying the remaining 120° segment. Several synthetic diamond stand-off type studs are strategically located and inserted in insert holes formed in the face of the drag bit leg. Nozzles are placed in front of the cutting face of the diamond studs to cool and clean the studs as the bit works in a borehole.

2 Claims, 5 Drawing Figures

TWO CONE BIT WITH EXTENDED DIAMOND CUTTERS

BACKGROUND OF THE INVENTION

1. Field of the Invention

This invention relates to a hybrid type rock bit.

More particularly, this invention relates to a roller cone type rock bit wherein one leg of a three leg rock bit is converted to a diamond studded drag bit segment, the remaining two legs support roller cone cutters.

2. Description of the Prior Art

U.S. Pat. No. 4,006,788, assigned to the same assignee as the present invention, describes a rock bit for recovering core samples as well as rock bit variations for drilling oil wells or the like. In each of the several embodiments described, diamond cutters are strategically mounted on the bit body for cutting rock by a shearing action. Each diamond cutter is in the form of a thin diamond plate bonded to a tungsten carbide stud that is inserted into the bit body. Means are also provided for limiting the depth of penetration of the diamond cutters into the rock formation being drilled. For example, rolling cone cutters with a plurality of tungsten carbide inserts protruding from their surfaces limit penetration of the diamond cutters. The protrusion of the carbide inserts from the surface of the cutter cones is less than the length of the diamond cutting face. Typically the diamond cutters are mounted for cutting one portion of the borehole area by shearing action and the rolling cone cutters are mounted for cutting another portion of its area by a chipping and crushing action.

The foregoing patent is disadvantaged in that the multiplicity of diamond cutters strategically placed on the various rock bit embodiments are inadequately cooled and cleaned during the borehole forming operation. Without adequate flow of fluid around and over each of the diamond inserts, the drag bit portion of the hybrid rock bits described may ball up, especially when they are passing through softer formations. In addition, with inadequate flow of fluid around the diamond inserts, the inserts become ineffective and may become overheated and damaged due to lack of cleaning and cooling.

The present invention teaches a means to increase the rate of penetration by utilizing a hybrid rock bit whereby one of the legs of a three leg bit is converted to a drag bit portion, the remaining two legs support conventional roller cones. The drag bit leg has a multiplicity of diamond cutters inserted in the face of the drag bit. Each of the diamond cutters are supplied with hydraulic passages for continuous cooling and cleaning of the cutters.

The diamond inserts may be so strategically positioned to cut the "hills" or high points in the hole bottom that are left uncut by the teeth in the two adjacent roller cones.

SUMMARY OF THE INVENTION

An object of this invention is to provide a hybrid bit with superior penetration rates, the hybrid bit being essentially a modification of a three cutter rock bit.

More particularly, it is an object of the invention to provide a hybrid bit wherein the third leg of a three cutter bit is converted to a drag bit portion having a multiplicity of diamond cutters inserted in the leg face, each of the cutters being supplied with hydraulic passages to cool and clean the diamond cutter elements in the drag bit portion.

It is a further object of this invention to provide a means to remove the high points in the formation on the hole bottom created between the rows of cutter elements in each of the adjacent two cones. The cutting teeth of each roller cone tend to "track" in the hole bottom. The penetration rate of the rock bit in the borehole is increased where "tracking" is minimized or eliminated.

Still another object of this invention is the use of a plurality of diamond inserts to scavenge the bottom surface sweeping the cuttings from the bottom, thus exposing new material for the rolling cutter cone teeth to penetrate and enhance rate of penetration.

A multi-segment hybrid rock bit is disclosed, the bit being of the type wherein drilling fluid or mud is directed into a chamber formed by the bit and out through openings downstream of the chamber. At least one leg segment of the bit is converted to a drag bit segment with insert cutting elements inserted in the face formed by the drag bit segment. The remaining leg segments support conventional roller cone cutters. A multiplicity of hydraulic passages are formed in the face of the drag bit leg segment, at least one of the hydraulic passages is positioned adjacent to and in front of at least a pair of the insert cutting elements. The hydraulic passages communicate with the chamber formed in the hybrid bit.

An advantage then over state of the art hybrid rock bits is the means to assure that each of the cutting elements in the drag bit segment, such as diamond tipped insert studs, are cooled and cleaned continuously during the drilling operation of the bit in a borehole.

A further advantage over the prior art is the means wherein the cutting elements in the drag bit portion of the hybrid bit remove the "hills" formed by the track of the adjacent roller cone cutters, thus providing a surface that substantially eliminates "tracking" of the bit to more rapidly advance the hybrid bit in the borehole.

Still another advantage over the prior art is the ability to sweep the bottom of the borehole removing the detritus material impacted on the bottom by the scavenging action of the multiplicity of diamond cutters and by providing a crossflow of hydraulic mud from the drag bit leg segment toward the adjacent roller cone cutters and up the borehole.

The above noted objects and advantages of the present invention will be more fully understood upon a study of the following detailed description in conjunction with the detailed drawings.

FIG. 1 is a view looking up at the cutting face of one version of the hybrid bit, FIG. 2 is a partial cross-section taken through 2—2 of FIG. 1 illustrating the hydraulic passages in the drag bit segment of the hybrid bit, FIG. 3 is a partial cross-section of an alternative hybrid rock bit wherein tungsten carbide insert studs are inserted in the roller cones, FIG. 4 is a view looking up at the cutting face of FIG. 3, and FIG. 5 is a partial cross-section taken through 5—5 of FIG. 4.

DESCRIPTION OF THE PREFERRED EMBODIMENTS AND BEST MODE FOR CARRYING OUT THE INVENTION

Figure 1:
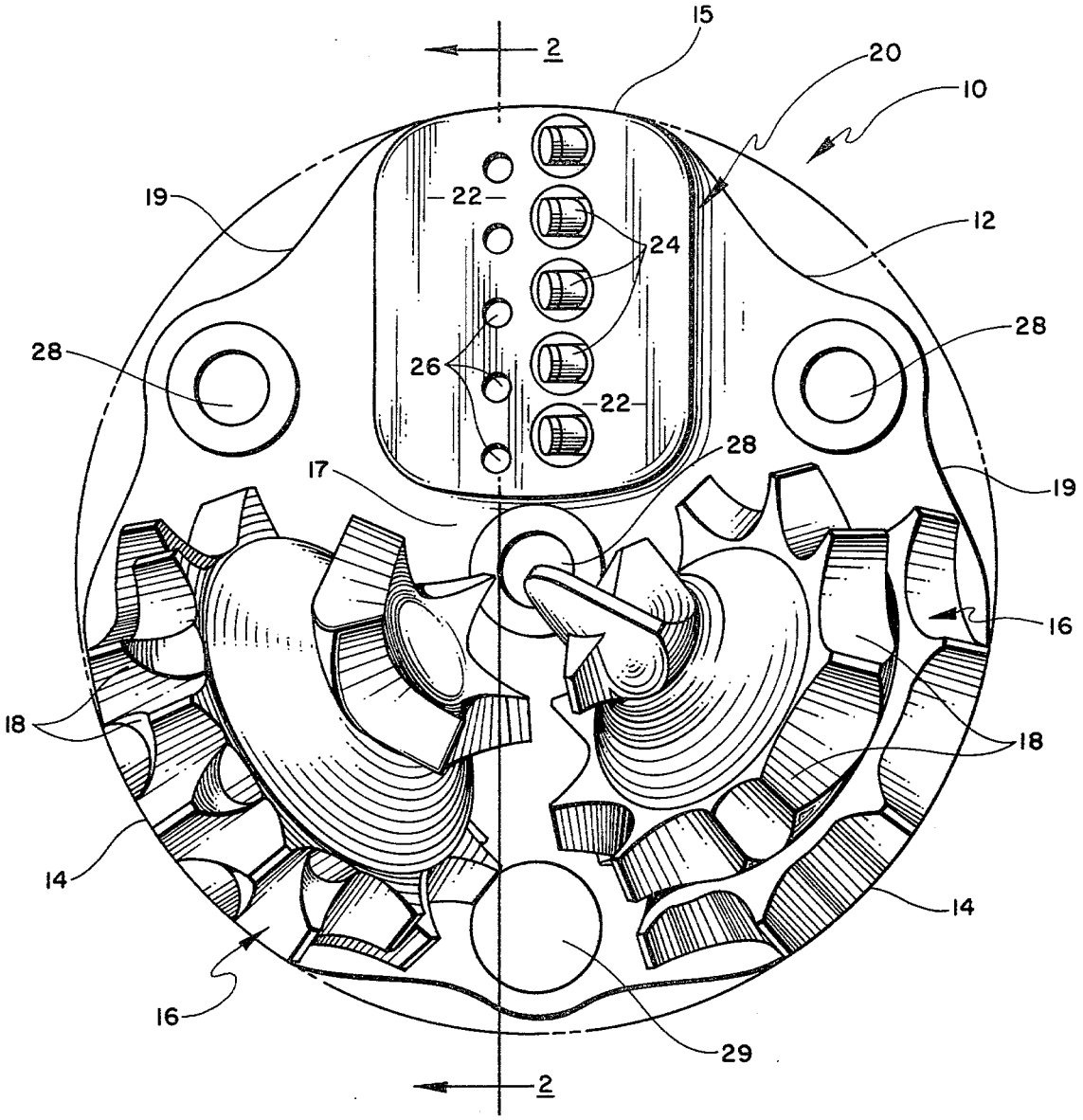

FIG. 1 depicts a hybrid rock bit, generally designated as 10, which consists of a bit body 12 comprised of two roller cone leg segments 14 and a drag bit leg segment 15. Cone cutters, generally designated as 16, are journalled to two leg segments 14. The drag bit leg segment 15 defines a drag bit face 22 which extends down toward the bottom of a borehole. A multiplicity of, for example, diamond insert studs 24 are inserted in the drag bit face 22. The diamond inserts are strategically positioned in the face to optimize the penetration rate of the hybrid bit 10.

Conventional synthetic diamond blanks typically are cemented, brazed, or sintered to an insert stud. The diamond layer is generally composed of a polycrystalline material joined to a substrate layer of tungsten carbide material. A synthetic diamond blank of the above description, for example, is manufactured by the Specialty Material Department of General Electric Company of Worthington, Ohio. The synthetic diamond blank goes by the trademark name of Stratapax drill blanks. The Stratapax blanks are typically brazed to the top extended portion of the studs.

In some applications, the diamond inserts in leg 15 may be replaced by tungsten carbide inserts.

Figure 2:
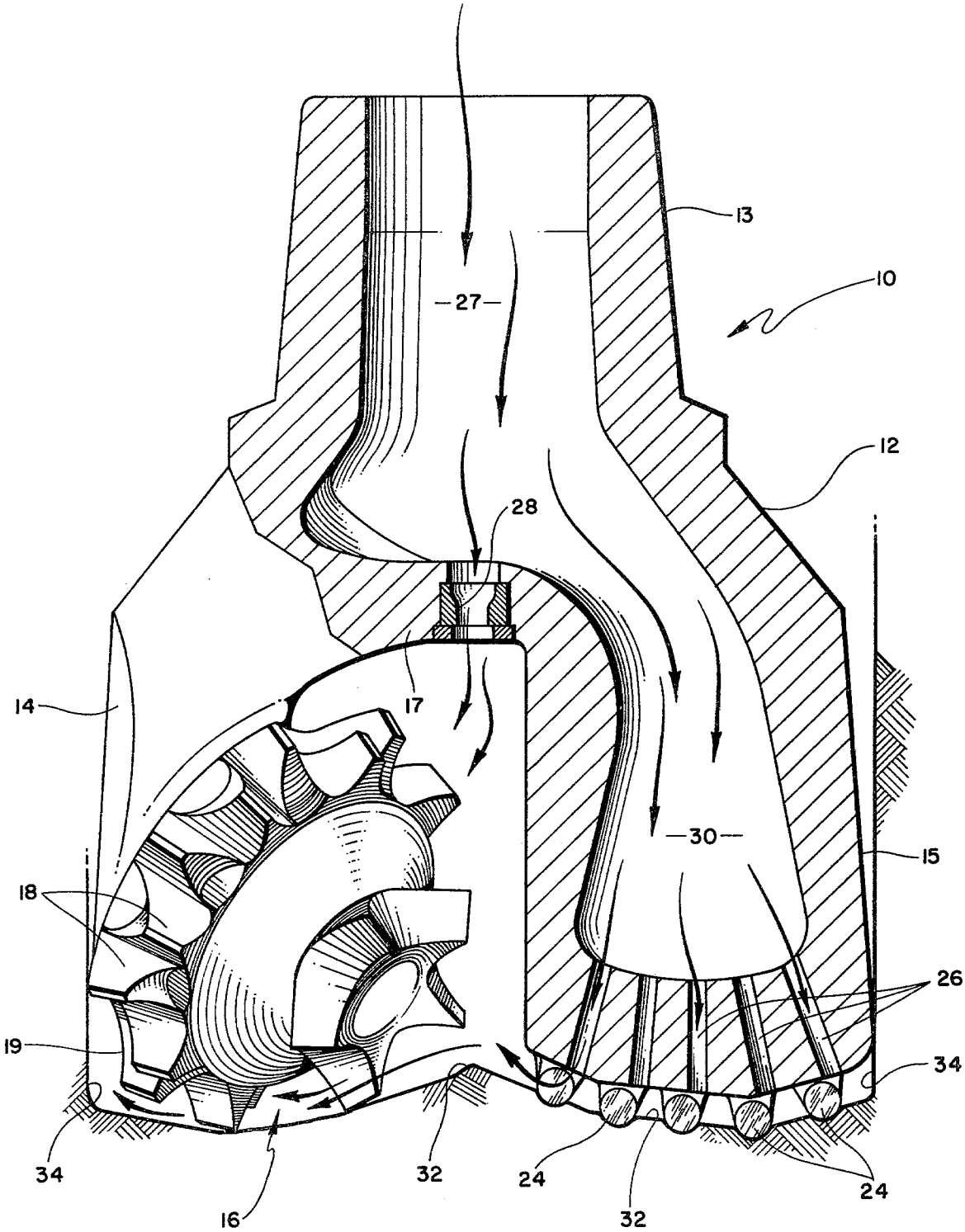

A series of hydraulic passages 26 are so positioned in front of each of the diamond studs 24 to effectively cool and clean each cutting tip of the studs. The hydraulic passages are, for example, constant diameter drilled holes which communicate with an inner hydraulic chamber 30 defined by the drag bit leg segment 15 (FIG. 2). A series of conventional hydraulic nozzles 28 are positioned within the bit body 12. A nozzle passage 29 (FIG. 1), normally positioned between the pair of cutter cones nearest the gage row 19, is plugged. The reason for plugging the hydraulic passage is to induce a cross-flow of fluid from drag bit passages 26 and nozzles 28. Drilling fluid or mud then passes across the borehole bottom through the pair of cones 16 and up the borehole past plugged nozzle opening 29. A central nozzle in the dome 17 directs hydraulic fluid over the cones 16 to prevent "balling" of the cones.

The center nozzle can be of a standard configuration as shown by 28 (FIG. 2) or it can be a diffusion type nozzle.

With specific reference to FIG. 2, hydraulic fluid enters through pin segment 13 into upper hydraulic chamber 27 defined by the bit body 12 and from there into each of the nozzles 28 and down into lower hydraulic chamber 30 defined by drag bit leg 15. Mud exits passageways 26 toward each of the diamond inserts 24.

The hybrid bit illustrated in FIGS. 1 and 2 performs as follows during operation. The initial rate of penetration of the two cone cutter bit is, of course, highest with the milled teeth 18 still sharp. As the milled teeth formed on the cone 16 become dull, the diamond cutter studs 24 then are buried deeper into the borehole bottom 32 and contribute more to the rate of penetration. Initially the cutting tip of each stud engages the bottom of the hole 32 with about 0.05 inches of burial depth. Therefore, the diamond cutters initially shear the tops of the "hills" of the craters formed by the milled teeth of the two cone cutters 16. The diamond cutters additionally act as a blade or sweep to provide a clean non-tracking bottom 32 for the following milled tooth cones 16.

With passage of time, the dulled cones working the borehole tend to serve more as stabilizers for the diamond cutters doing most of the drilling.

Figure 3:
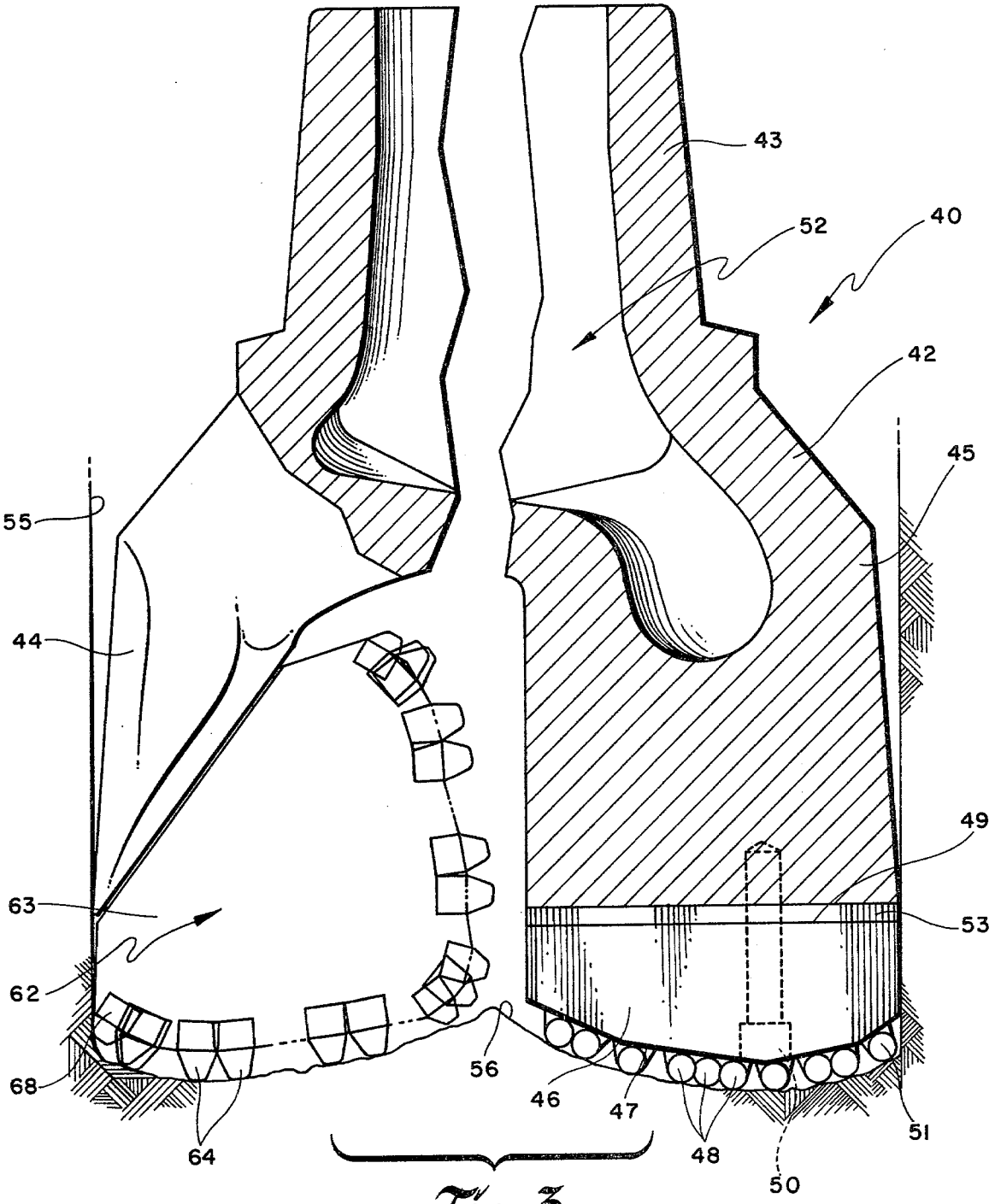

FIG. 3 illustrates an alternative embodiment of a hybrid rock bit, generally designated as 40. Bit 40 comprises bit body 42 with pin end 43 and a pair of 120° leg segments 44. Each leg segment 44 has attached a roller cone 62 consisting of cone body 63 which has a plurality of, for example, tungsten carbide inserts 64 pressed into the cone body. A drag bit segment 45 makes up one 120° segment of the three segment hybrid bit as indicated in FIG. 1. The standard leg segment with cone 62 journalled to segment 44 is shown rotated about 90° so that the axis of the cone journalled to the leg is in alignment with the row of diamond inserts 48 imbedded in drag bit head 46, bolted to the drag bit leg segment 45. The bit is illustrated in this way to indicate the track of the diamond inserts relative to the tungsten carbide inserts 64 on the cone 62.

The drag bit head 46 with the plurality of diamond inserts 48 inserted in face 47 of bit 46 is attached to the drag bit leg segment by a series of attachment bolts 50. A shim 53 is inserted between base 49 of head 46 and the end of the drag bit segment 45. Obviously, the thickness of the shim determines the depth of penetration of the tips of the diamond inserts 48.

As the standard cones 62 rotate in the bottom 56 of borehole 55, a series of "hills" or high points result as the tungsten carbide inserts track in the borehole bottom. The diamond inserts 48 are so positioned to scavenge the hole bottom 56 as well as to clean or remove the high points left by the tungsten carbide inserts in the standard roller cone 62.

Figure 4:
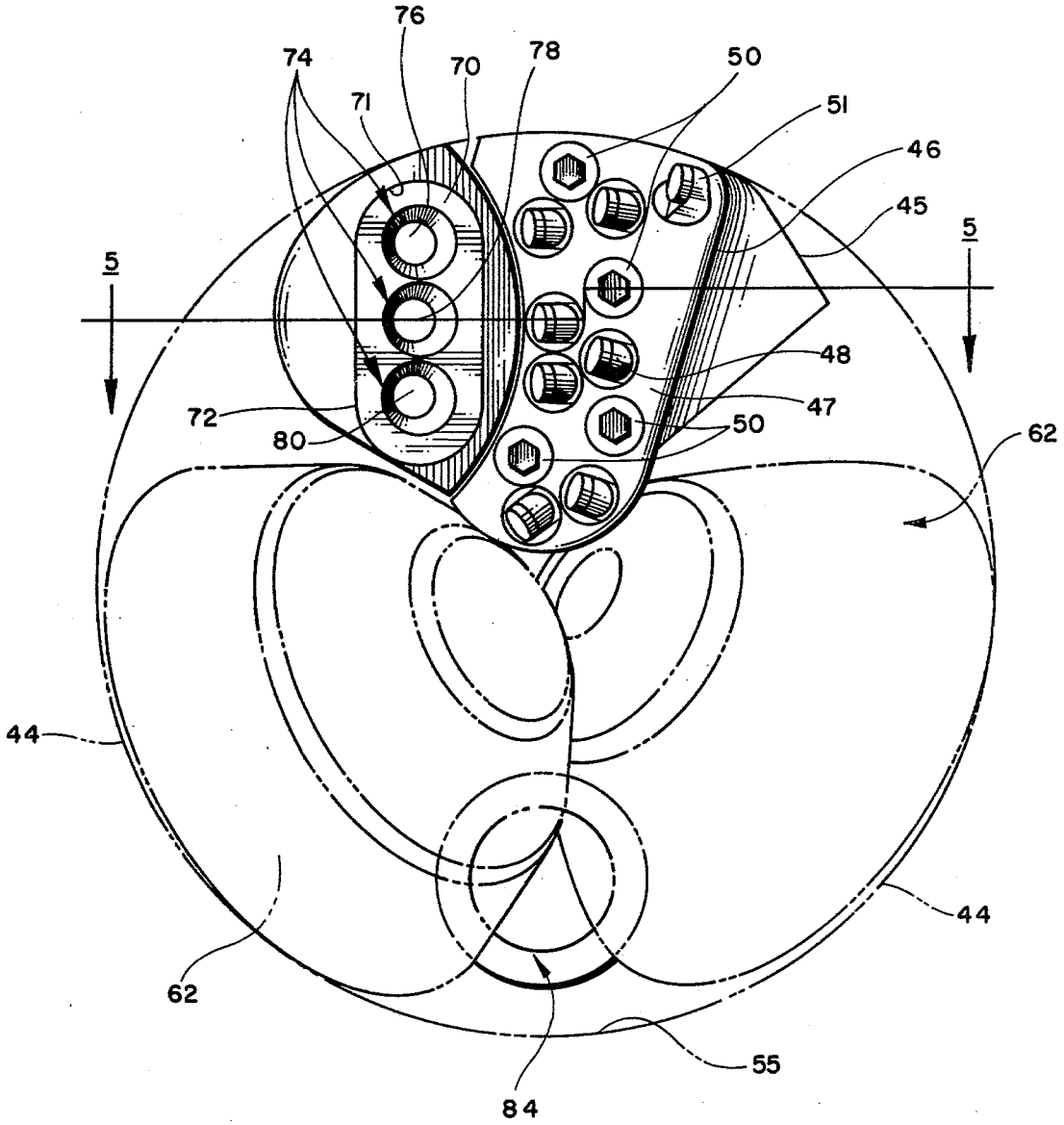
Figure 5:
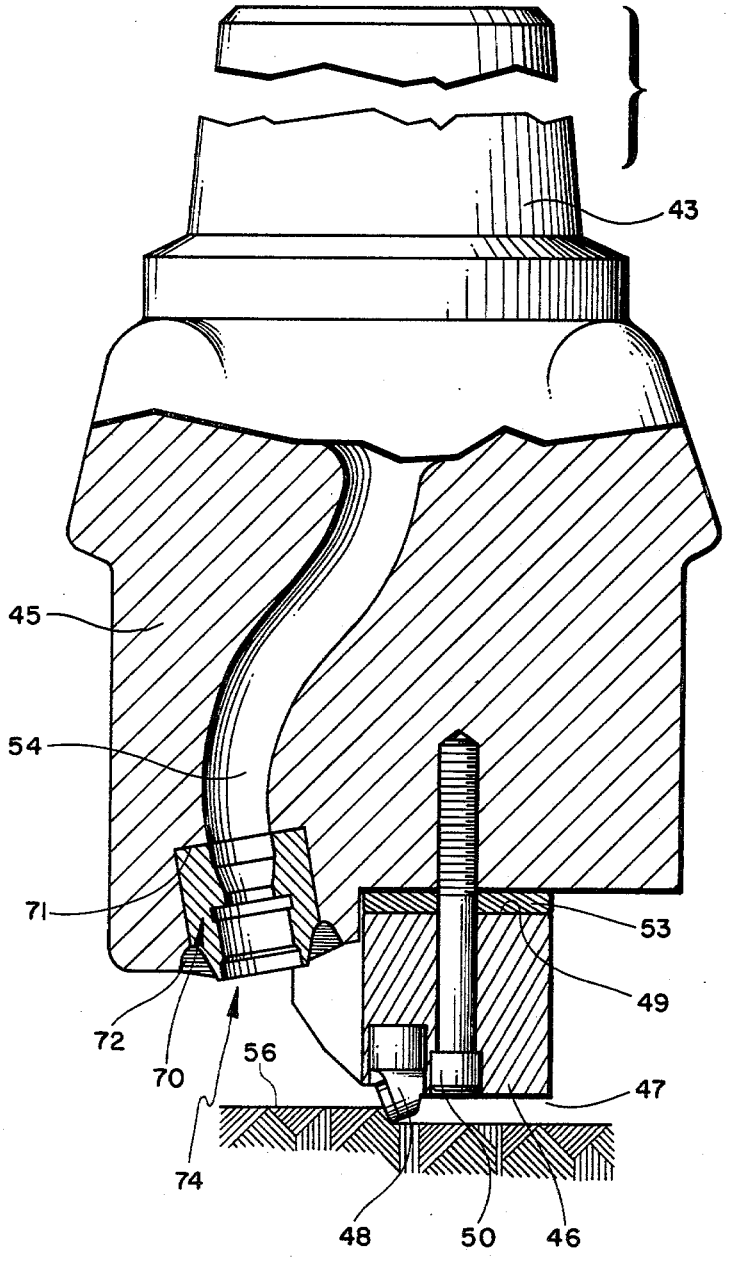

Turning now to FIG. 4, a nozzle support base 71 is machined into the drag bit leg 45 in front of the drag bit head 46. A nozzle support body, generally designated as 70, is fabricated to nest on the base 71 of drag bit leg 45. The nozzle support body is welded into the base 71 at weld interface 72. A series of conventional hydraulic jet nozzles, generally designated as 74, are secured to the nozzle support body 70 (FIG. 5).

The nozzle base 70, for example, supports three nozzles 76, 78 and 80. Nozzle 76 is so oriented to direct hydraulic fluid over at least three of the diamond inserts oriented toward the peripheral edge of the hybrid bit 40 and to the kerf 82 of borehole 55, the center nozzle 78 being directed toward the bottom of the borehole 56 and toward the middle diamond inserts 48 while the inner nozzle 80 is directed toward the center of the borehole, cooling and cleaning the inner diamond inserts while sweeping the cuttings from the bottom 56. Drilling fluid or mud moves through the conventional tungsten carbide insert cones 62 and up the borehole 55. Thus the conventional nozzles 74 serve to cool and clean each of the diamond inserts 48 while providing hydraulic fluid to sweep the cuttings from the bottom of the borehole 56. A conventional nozzle 84 may be positioned between the cones 62 to prevent the cones from balling in soft formations and to aid the hydraulic removal of cuttings from the bottom of the borehole 56.

It will of course be realized that various modifications can be made in the design and operation of the present invention without departing from the spirit thereof. Thus, while the principal preferred construction and mode of operation of the invention have been explained in what is now considered to represent its best embodiments has been illustrated and described, it should be understood that within the scope of the appended claims, the invention may be practiced otherwise than as specifically illustrated and described.

I claim:

1. A three leg segment hybrid rock bit, each leg segment being about 120°, said bit is of the type wherein hydraulic mud is directed to a chamber formed in said bit and out through openings downstream of said chamber, at least one 120° leg segment of said bit is converted to a drag bit segment with insert cutting elements inserted in the face formed by said drag bit segment, the remaining 120° leg segments supporting conventional roller cone cutters, the hybrid bit further comprising:

a multiplicity of hydraulic passages formed in said face of said drag bit leg segment adjacent said insert cutting elements, at least one of said hydraulic passages being positioned adjacent to and in front of at least a pair of said insert cutting elements in said 120° drag bit leg segment, said hydraulic passages communicating with said chamber formed in said hybrid bit, and a passage for crossflow of said hydraulic mud exiting said hydraulic passages adjacent said insert cutting elements in said 120° drag bit segment and formed between said adjacent roller cone cutters, said crossflow passage between the roller cutters having no hydraulic passage communicating with said chamber, thereby sweeping detritus material from the bottom of a borehole formed by said hybrid rock bit to the exterior of the bit and up the borehole.

2. The invention as set forth in claim 1 wherein said passage for crossflow of hydraulic mud across the borehole bottom includes the positioning of all of said hydraulic passages in and adjacent to said 120° drag bit leg segment, said hydraulic mud exiting said passages cleans and cools each of said insert cutting elements then moves across the borehole bottom past said roller cones supported by said remaining two 120° leg segments thereby sweeping said detritus material from said borehole bottom.

* * * * *